United States Patent [19]

Lyon et al.

[11] 4,103,807

[45] Aug. 1, 1978

[54] COMPOUND BOW HOLSTERS

[76] Inventors: John A. Lyon, 4745 Damon Ave.; Robert E. Whyel, Jr., 819 Rex Blvd. NW, both of Warren, Ohio 44485

[21] Appl. No.: 774,930

[22] Filed: Mar. 7, 1977

[51] Int. Cl.[2] ..... F41B 5/00

[52] U.S. Cl. ..... 224/1 R; 224/3; 224/5 E

[58] Field of Search ..... 224/1 R, 1 A, 2 A, 3, 224/5 R, 5 E, 5 A, 26 K, 26 R

[56] References Cited

U.S. PATENT DOCUMENTS

| | | | |
|---|---|---|---|
| 919,301 | 4/1909 | Anderson | 224/3 |
| 1,043,675 | 11/1912 | Crockett | 224/5 B |
| 2,781,958 | 2/1957 | Lewandowski | 224/5 E |
| 3,127,075 | 3/1964 | Yavello | 224/2 A |
| 3,208,653 | 9/1965 | Wallace | 224/1 R |
| 3,998,367 | 12/1976 | Harding | 224/1 A |

*Primary Examiner*—Trygve M. Blix
*Assistant Examiner*—Jerold M. Forsberg
*Attorney, Agent, or Firm*—Michael Williams

[57] ABSTRACT

A holster for a compound bow, comprising straps of flexible material which are formed and connected to provide the holster for receiving an end portion of a compound bow, and a supporting strap connected at its lower end to the holster and its upper end being adapted for connection to the belt of an archer. Elastic bands are connected to the holster and are adapted to encircle a leg portion of the archer to maintain the holster in steady position.

7 Claims, 5 Drawing Figures

COMPOUND BOW HOLSTERS

BACKGROUND AND SUMMARY

Compound bows are widely used for hunting and target practice and they are distinguished from the ordinary bow in that they have the bowstring passing over eccentric wheels which are located at the ends of respective upper and lower limbs of the bow. In some compound bows the bowstring also passes over upper and lower pulley assemblies which are spaced inward of respective eccentric wheels.

While the pulleys and eccentric wheels are desirable since they coact with the bow structure to increase the power of the bow, they do have the disadvantage of adding weight to the bow, and such weight, combined with the weight of the sturdier bow handle and limbs, makes it tiresome when the bow is carried for any length of time. Some archers sling the bow over their shoulder, but this is inconvenient and, in any event, disposes the bow out of shooting position. Frequently, when a hunter stops walking, he will rest the lower end of the bow on the ground, and this is undesirable since mud, leaves and other debris commonly found in the woods will accumulate on the lower eccentric wheel and impair the usefulness of the bow.

Our invention provides a holster in which the lower end of the bow may be deposited. The holster is supported by a strap that is connected to the belt of the archer, this strap being adjustable in length so that the holster is comfortably disposed just above the knee area of the archer so as not to interfere with walking movement. An elastic strap, also adjustable in length, is connected to the holster and is adapted to encircle a thigh portion of the archer so as to hold the holster steady.

In case of right handed archers, the holster is supported in alignment with the left leg, and the bow is held in upright position by the left hand. Thus, the bow is always in position for shooting an arrow.

DESCRIPTION OF THE DRAWINGS

In the drawings accompanying this specification and forming a part of this application, there is shown, for purpose of illustration, an embodiment which our invention may assume, and in these drawings.

DESCRIPTION OF THE PREFERRED EMBODIMENT

Figure 1:
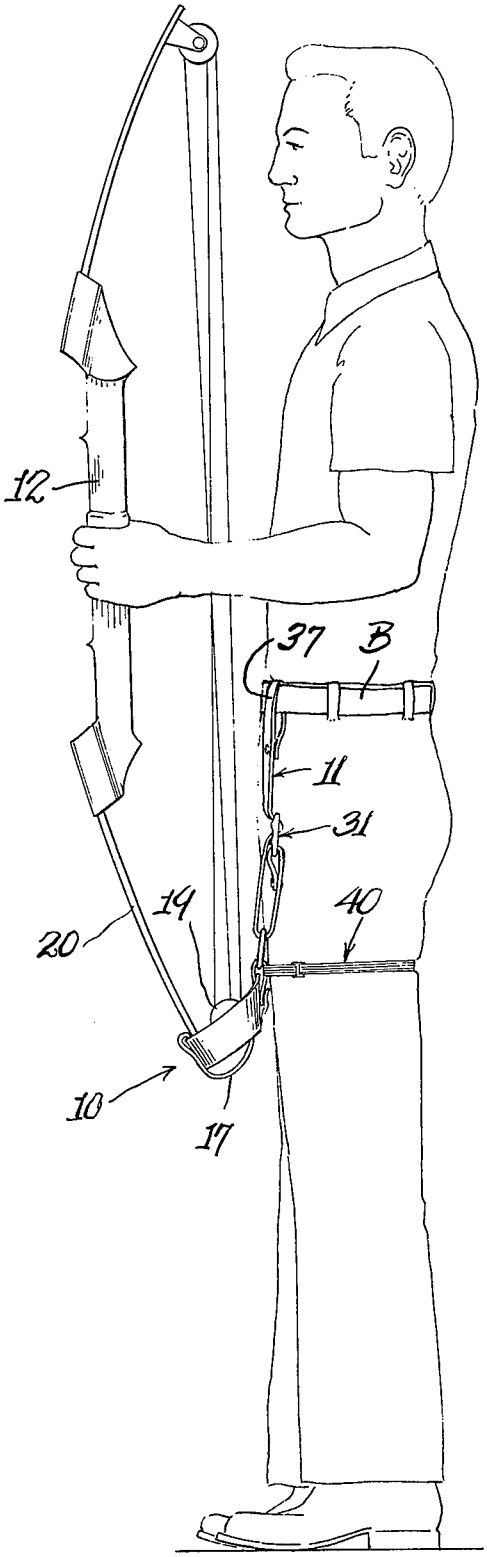
FIG. 1 is a side elevational view of a compound bow, shown as supported in upright position in our novel holster, the latter being connected to the archer's belt and thigh.

The holster 10 is shown in FIG. 1 as normally worn by a right-handed archer, and is supported by a strap 11 in position slightly above the left knee of the archer. The left hand of the archer is shown as graping the bow handle 12 to support the bow upright in just about the position for shooting of an arrow. it will be appreciated that in the case of left-handed archers, the position will be reversed.

Figure 2:
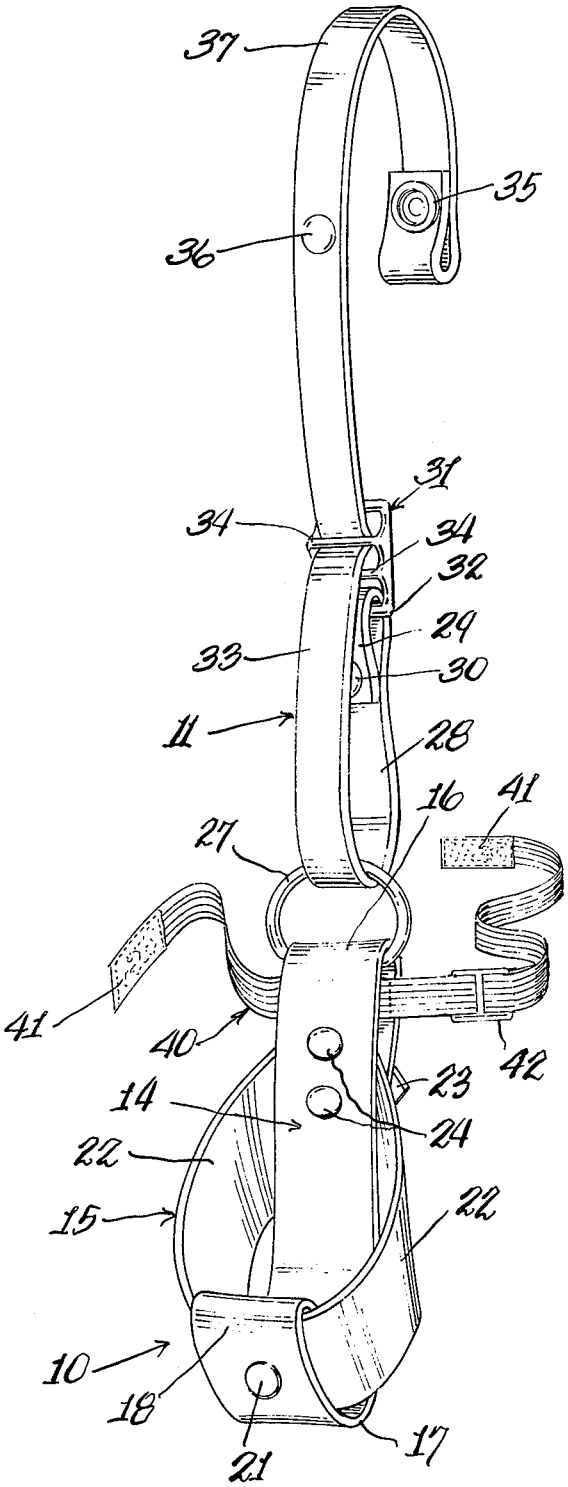
FIG. 2 is an enlarged, perspective view of the holster and connecting straps.
Figure 3:
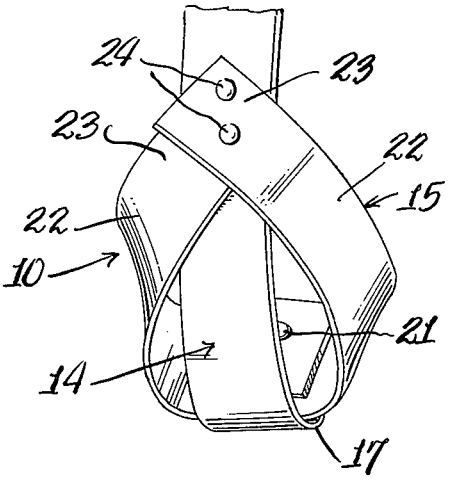
FIG. 3 is a perspective view of the holster per se, looking from a different angle than in FIG. 2, and FIGS. 4 and 5 are fragmentary sectional views showing the holster supporting two different types of compound bows.
Figure 4:
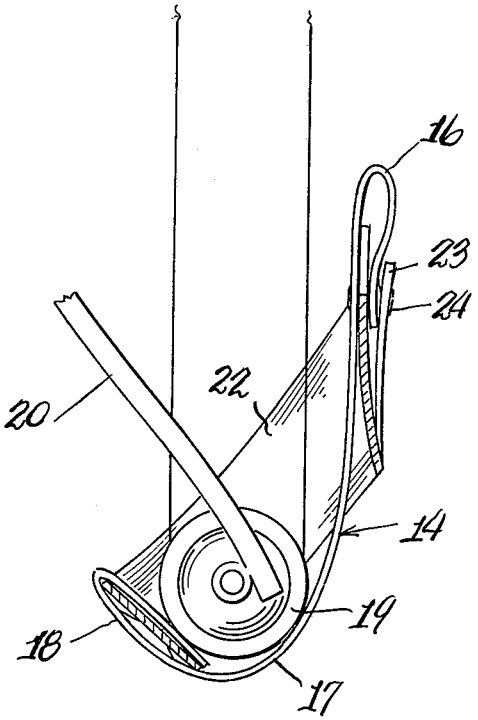
Figure 5:
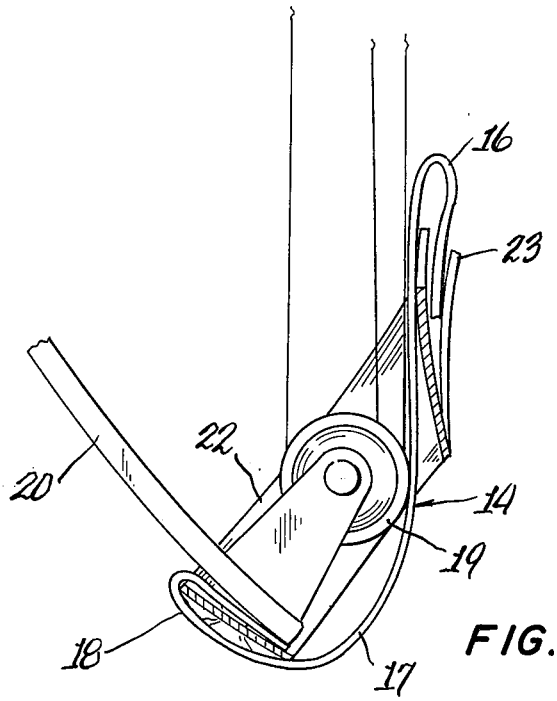

Referring particularly to FIGS. 2 and 3, the holster comprises a pair of straps 14 and 15, each made of leather, plastic or like flexible material, and having substantial width and thickness to withstand rough usage. The strap 14 extends vertically and has its upper end doubled over to form a loop 16. As best seen in FIGS. 4 and 5, the strap 14 has a curved lower portion 17, the extremity of which is turned upwardly and doubled over itself to form a loop 18. The curved portion 17 is of a size to comfortably receive the lower eccentric wheel 19 carried by the lower limb 20 of the bow.

The strap 15 has an intermediate portion disposed within the loop 18 of the strap 14. A rivet 21 passes through this intermediate portion and through the parts of strap 14 which form the loop 18, and is headed to maintain assembly of the loop and intermediate portions. Opposite side portions of the strap 15 are bowed outwardly and inclined upwardly, as seen at 22, and their extremities overlap at the rear of loop 16 of the strap 14, as best seen at 23 in FIG. 3. A pair of rivets 24 pass through the overlapped extremities of strap 15 and the doubled over end of strap 14 to maintain assembly of the straps 14 and 15 at this point.

As seen in FIGS. 4 and 5, the curved lower portion 17 of strap 14 defines a cradle support for the lower end of the bow and into which such end may be easily deposited or from which such lower end may be easily removed for shooting action. In some cases, the bow may be used to shoot an arrow while its lower end is supported in the cradle support. The bowed side portions of the strap 15 form sides for the cradle support so that the lower end of the bow will not be displaced from the holster by laterial movement of such end.

A metal D-ring 27 has a portion contained within the loop 16 and the supporting strap 11 has a lower end looped through the ring. The strap 11 is also made of leather, plastic or like flexible material, and it need not be as heavy as the straps 14 and 15 since it operates under tension and is not subject to the rough usage to which the straps 14 and 15 are subjected. One leg 28 of the supporting strap extends upwardly from the D ring 27 and has its extremity doubled over to form a loop 29. A rivet 30 holds the doubled over portions of the leg 28 together.

An adjusting buckle 31 of conventional design has its lower crossbar 32 disposed within the loop 29. The other leg 33 of the supporting strap 15 is threaded through a buckle opening which is defined by two spaced crossbars 34 for the purpose of providing for adjustment of the length of the supporting strap 11. The upper end of the leg 33 is doubled over and a snap rivet 35 extends through the extremity of the leg. Another snap rivet 36 is fixed to the stap 11 in position spaced from the upper extremity of the leg 33. The snap portions of the rivets 35 and 36 are interengageable to form a loop 37 so that the supporting strap 11 may be connected to the belt B (see FIG. 1) of the archer.

An intermediate portion of an elastic strap 40 passes through the loop 16 of the holster strap 14, as best seen in FIG. 2, and this portion is preferably stitched or otherwise secured to the strap 14. Opposite ends of the elastic strap extend laterally from the loop 16 and each end has connecting means thereon for connecting the same. In the embodiment herein disclosed, such connecting means are in the form of strips 41 of Velcron which provides readily connectable and disconnectable means. One or both of the ends of the elastic strap 40 is provided with an adjusting buckle 42 so that the length of the strap may be adjusted for connection around the thigh of the archer. The elastic strap 40 holds the holster 10 against laterial shifting movement.

In use, with the holster attached to the archer, the latter may dispose the lower end of the bow within the holster and grasp the bow handle with one hand to steady the bow. The bow is thus supported off the ground and is in ready position for the archer to shoot an arrow.

We claim:

1. An accessory to be worn by an archer for supporting a compound bow which includes a handle, limbs extending from opposite ends of the handle, and a wheel at the end of each limb over which the draw string is trained, the accessory comprising:

a holster of a size and shape to receive one said wheel and the adjoining portion of a limb at one end of the bow, said holster including a pair of flexible straps;

one said strap extending generally vertically and defining a U-shaped curved configuration having upstanding portions and having width sufficient to define a cradle to engage and support said bow wheel and limb, said one strap terminating at one upper end in a connecting portion;

the other said strap disposed generally in a plane transverse to said one strap and inclined from the vertical when said holster is in normal use, said other strap defining a loop respectively connected at generally opposed portions thereof to said upstanding portions of said one strap, one said upstanding portion being disposed adjacent an end of said one strap and the other upstanding portion being disposed adjacent said upper end and between said connecting portion and said cradle;

said other strap thereby defining side guards for the cradle to prevent lateral dislodgement of said bow therefrom, and, supporting means extending from and secured to said one strap connecting portion and including:

(1) adjustable belt strap means for securement to the waist of the archer thereby to support pendently substantially the entire weight of the bow when holstered, and, (2) detachable leg strap means for securement to the leg of the archer adjacent said holster thereby to maintain said holster substantially laterally stable when so secured, whereby holstering said bow with both said belt strap means and said leg strap means secured provides a substantially rigid bow support for target and like standing position purposes of the archer, while holstering said bow with said belt strap means secured and with said leg strap means detached permits weight support of said bow with lateral flexibility of said holster for transport, crouching, setting and like activities of the archer.

2. The construction according to claim 1 wherein said one strap has loops at its opposite ends with an intermediate portion of said other strap disposed within one loop, and said supporting means being connected to the other loop of said one strap.

3. The construction according to claim 2 wherein a metal D-ring is held within said other loop, and said leg strap supporting means comprising a flexible strap having a loop portion held within the opening of said D-ring.

4. The construction according to claim 3 wherein the flexible strap comprising said supporting means is formed by a pair of leg portions joined by a bight to form the loop, and a length adjusting buckle at the end of one of said legs and through which the other of said legs is threaded.

5. The construction according to claim 4 wherein the end of said other leg is provided with longitudinally spaced snaps which are interengagable to double up said other leg end to form a loop through which the belt of the archer may be disposed.

6. The construction according to claim 5 wherein the leg strap means includes an intermediate portion of an elastic strap is disposed within the loop in which said D-ring is disposed, said elastic strap having extending ends which are adapted to be connected around the leg of the archer to steady said holster.

7. The construction according to claim 6 wherein a Velcro strip material is secured to the extremity of the ends of said leg strap means, for ready connection and disconnection of such ends.

* * * * *